United States Patent [19]

Clancey et al.

[11] 4,008,054

[45] Feb. 15, 1977

[54] PROCESS FOR MAKING LOW-SULFUR AND LOW-ASH FUELS

[75] Inventors: James T. Clancey; Everett Gorin; Eric H. Reichl; Charles H. Rice, all of Pittsburgh, Pa.

[73] Assignee: Consolidation Coal Company, Pittsburgh, Pa.

[22] Filed: Jan. 10, 1975

[21] Appl. No.: 540,310

[52] U.S. Cl. ..... 44/10 R; 44/10 C; 44/13; 48/197 FM; 201/6; 208/8

[51] Int. Cl.[2] ..... C10L 5/00; C10G 1/00

[58] Field of Search ..... 208/8; 44/10 R, 13, 44/10 C; 201/6; 48/197 FM

[56] References Cited

UNITED STATES PATENTS

| | | | |
|---|---|---|---|
| 3,748,254 | 7/1973 | Gorin | 208/8 |
| 3,791,956 | 2/1974 | Gorin et al. | 208/8 |
| 3,840,456 | 10/1974 | Yavorsky | 208/8 |

*Primary Examiner*—Carl F. Dees

*Attorney, Agent, or Firm*—William A. Mikesell, Jr.; D. Leigh Fowler, Jr.; Stanley J. Price, Jr.

[57] ABSTRACT

Low-sulfur and low-ash gaseous, liquid and solid fuels are made from coal by a process which first subjects the coal to solvent extraction and hydrotreatment under hydrodesulfurizing conditions in a coal liquefaction zone to reduce the organic sulfur content of the coal. The effluent is divided into a low-solids product which contains most of the extract and a high-solids product which contains most of the remaining inorganic sulfur and other mineral matter. The low-solids product stream which contains extract and solvent is subjected to a forming step to yield low-ash and low-sulfur pellets. The high-solids product stream is subjected to gasification to yield hydrogen for use in the liquefaction step. The process is particularly adapted to supply the energy needs of a steel plant, including the required coke.

7 Claims, 2 Drawing Figures

PROCESS FOR MAKING LOW-SULFUR AND LOW-ASH FUELS

BACKGROUND OF THE INVENTION

1. Field of the invention

This invention relates to a process for converting coal to low-sulfur and low-ash gaseous, liquid and solid fuels, and more particularly, to a process for supplying the energy requirements of a steel plant from an ash- and sulfur-containing coal.

2. Description of the Prior Art

The primary source of energy for the steel industry continues to be coke for the blast furnace. The conventional method for coke manufacture, that is, by slot ovens, requires a blend of high and low volatile coals of proper swelling properties to produce a strong coke without damaging the ovens. Beyond these physical properties, there is a need for desirable chemical properties (i.e. low ash and sulfur content) to permit low-cost production of high quality hot metal. With the continued expansion of the world's productive capacity for steel, a growing shortage of good metallurgical coals is developing, particularly those having the essential low volatile coal ingredients. Low-sulfur coals also are in short supply because the electric utilities now compete for such coals to satisfy environmental requirements.

In addition to the energy supplied by coke and coke oven by-products, the steel industry consumes liquid and gaseous fuels for blast furnace injection, soaking pits, reheat furnaces, steam and power generation, etc. Future supplies of these fuels are also in jeopardy.

There are extensive reserves of coals in the United States, and in other parts of the world as well, sufficient in fact, to satisfy a substantial part of the energy needs of the world for centuries to come. Unfortunately, these coals in their indigenous state are not suitable for use either as clean fuel, i.e. low ash- and low sulfur-containing, or as feedstock for coke manufacture.

Accordingly, the primary object of the present invention is to provide a process for converting any coal, by itself, whether it be caking or non-caking, low sulfur or high sulfur, low ash or high ash, low volatile or high volatile, to a desired spectrum of clean gaseous, liquid and solid fuels. The solid fuel, for purposes of a steel plant, is coke, or formcoke. The term "formcoke" defines coke obtained by the calcination of preformed or preshaped carbonaceous solids and is used to distinguish from coke obtained as broken pieces of all sizes and shapes from conventional coke ovens.

The prior art is represented by the following patents and publications:

| | | | |
|---|---|---|---|
| U.S. 1,925,005 | - Rose | Aug. | 29, 1933 |
| 2,166,321 | - Pott | July | 18, 1939 |
| 2,664,390 | - Pevere et al. | Dec. | 29, 1953 |
| 2,686,152 | - Franke | Aug. | 10, 1954 |
| 3,018,242 | - Gorin | Jan. | 23, 1962 |
| U.S. 3,240,566 | - Bullough et al. | Mar. | 15, 1966 |
| 3,401,089 | - Friedrich et al. | Sept. | 10, 1968 |
| 3,562,783 | - Gorin | Feb. | 9, 1971 |
| 3,748,254 | - Gorin | July | 24, 1973 |
| 3,791,956 | - Gorin et al. | Feb. | 12, 1974 |

German Pat. No. 320,056 - Rutgerswerke AG - Apr. 21, 1920 "Process for the Solvent Extraction of Coal"

Bureau of Mines Information Circular - I.C. 7420 (Oct. 1947) "Pott-Broche Coal-Extraction Process and Plant of Ruhrol G.m.b.H., Bottrop-Welheim, Germany".

SUMMARY OF THE INVENTION

The present invention is an improvement in the process for liquefaction of coal by solvent extraction which comprises, in its broadest aspects, the following essential operations:

1. Simultaneous solvent extraction and hydrotreatment of the coal in a coal liquefaction zone under hydrodesulfurizing conditions selected to yield a coal extract having a lower organic sulfur content than the coal;
2. separation of the liquefaction product into at least two parts, the first part being a low solids-containing product containing said coal extract, and the second part being a high solids-containing product containing said undissolved ash-containing hydrocarbonaceous residue;
3. treatment of the first part, as follows:
   a. recovery of the major portion of the solvent for recycle to the liquefaction zone;
   b. production of a pelletizable mixture of coal extract and carbonaceous solids;
   c. formation of pellets from the pelletizable mixture; and
   d. induration of the pellets, concurrent with, or subsequent to their formation, to form hardened low-ash and low-sulfur pellets;
4. treatment of the second part, as follows:
   a. distillation of the second part to yield a hydrocarbonaceous ash-containing solid and a hydrocarbonaceous distillate; and
   b. reaction of said hydrocarbonaceous ash-containing solid with steam in a steam-carbon gasification zone to yield a gaseous product and ash-containing inorganic sulfur;
5. recovery of a hydrocarbonaceous distillate fraction from said hydrocarbonaceous distillate for use as solvent in the liquefaction zone; and
6. treatment of the gaseous product from the gasification zone to yield a methane-rich gas and hydrogen for use in the liquefaction zone.

The advantages of the process of the present invention include the following:

1. A single coal, whether it be caking or non-caking, high sulfur or low sulfur, high volatile or low volatile, high ash or low ash, may be used to satisfy the energy requirements of an ore reduction plant.
2. The process may be readily operated continuously to yield a spectrum of fuels whose distribution and respective compositions may be regulated in response to conditions maintained in the coal liquefaction zone and the separation zone.
3. The process permits autogenous maintenance of solvent balance and hydrogen requirements.
4. The process is especially valuable in its application to high-sulfur and high-ash coals. A variety of ash-free fuels which are substantially free of inorganic sulfur and much reduced in organic sulfur may be readily obtained as will be apparent from the following more detailed description of the invention in its broadest aspect and in its preferred embodiment.

THE INVENTION (in its broadest aspects)

Liquefaction

Figure 1:
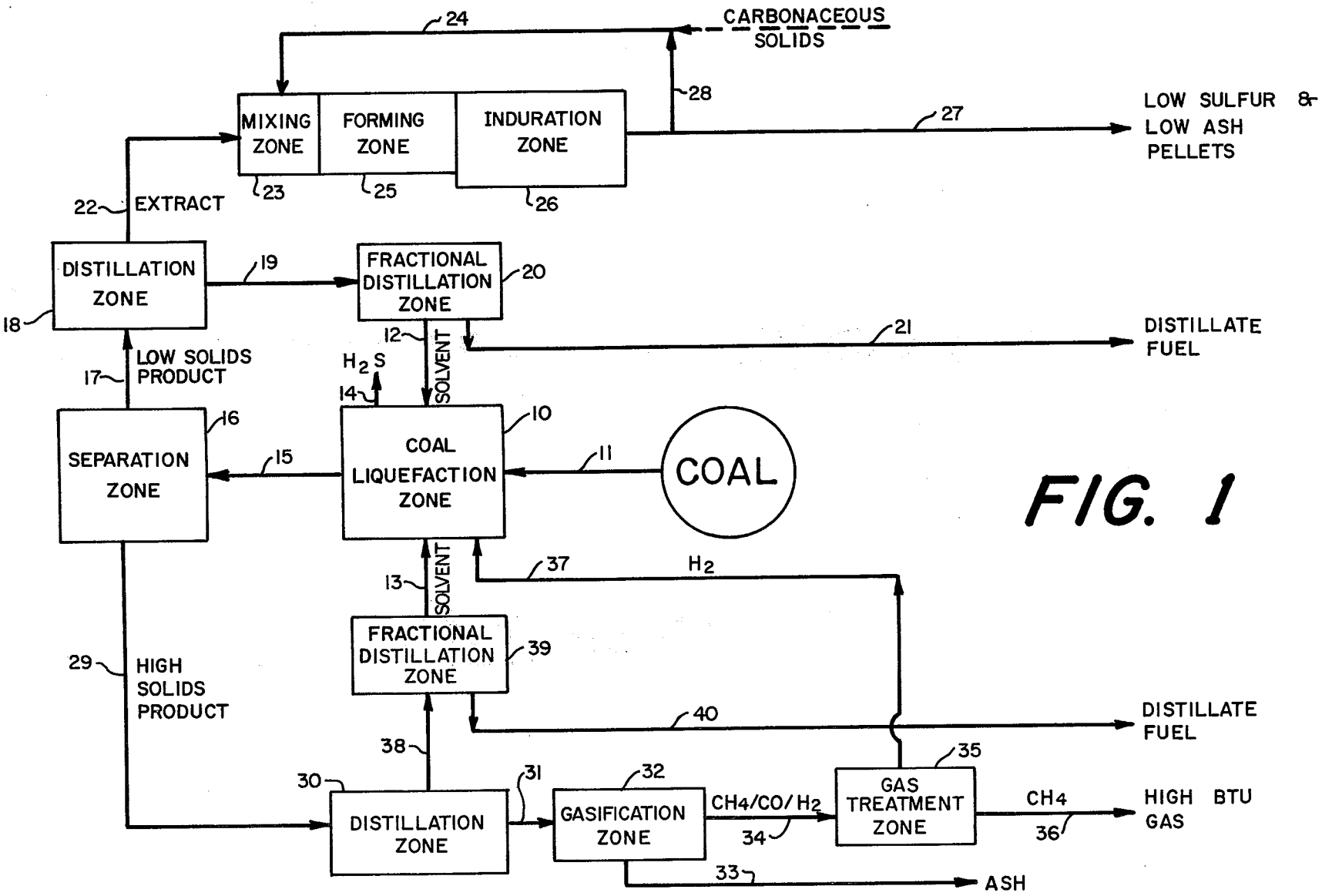
FIG. 1 is a schematic flowsheet of the present invention in its broadest aspects.

Referring to FIG. 1, coal and liquefaction solvent are introduced into a coal liquefaction zone 10. The coal is introduced through line 11. The liquefaction solvent is introduced through lines 12 and 13.

Any coal may be used in the process of this invention, non-limiting examples of which are lignite, bituminous coal and sub-bituminous coal. The coal may be non-caking, weakly caking or caking. It may be low in sulfur or high in sulfur, or in-between; it may be low in ash or high in ash, or in-between; or it may be low volatile or high volatile, or in-between. The process of the present invention is of especial value in the case of non-caking or weakly caking coals and high-sulfur coals since normally such coals have only limited utility.

A suitable liquefaction solvent is a mixture of polycyclic, aromatic hydrocarbons which is liquid under the conditions of temperature and pressure maintained during coal liquefaction. A suitable boiling range for such a solvent, for example, is within the range 230° to 475° C. The solvent may be conveniently derived as a distillate fraction from one or more of the unit operations of the present process.

The selected coal, in a finely divided state, is subjected to simultaneous solvent extraction and hydrotreatment in the liquefaction zone 10 under hydrodesulfurizing conditions. The extraction operation may be any of those used by those skilled in the art, for example, continuous, batch, countercurrent or staged extraction. Hydrogen for the hydrotreatment may be supplied as gaseous hydrogen, or by means of a hydrogen-donor solvent. If gaseous hydrogen is used, the solvent may be any suitable polycyclic aromatic hydrocarbon, or mixtures of polycyclic aromatic hydrocarbons which are liquid at the temperature and pressure of extraction. If a hydrogen-donor solvent is required, at least a portion of the polycyclic aromatic hydrocarbons is partially hydrogenated. Such a solvent is rehydrogenated to maintain its effectiveness as a hydrogen donor.

The conditions maintained in the extraction zone are those which are effective in desulfurizing the extract, that is, in reducing the organic sulfur content of the extract. Those conditions are generally known and are typically as follows:

| | Gaseous Hydrogen | H-Donor |
|---|---|---|
| Temperature, ° C. | 400–450 | 400–450 |
| Pressure, Kg/cm² | 70–200 | 5– 50 |
| H addition, Wt. % MAF*coal | 0.70–2.5 | 0.70–2.5 |
| Solvent to Coal (wt. ratio) | 1.5–3.0 | 1.5–3.0 |

*MAF is moisture-and ash-free coal

The product consists of an effluent gas (containing $H_2S$) which is rejected through a line 14 and an effluent slurry product (containing solvent, extract and undissolved hydrocarbonaceous solids and ash) which is conducted by a line 15 to a separation zone 16.

Separation of the Extraction Slurry

Separation of the effluent slurry from the liquefaction zone into at least two parts is effected in the separation zone 16 at elevated temperature, generally close to that of the liquefaction zone. The first part is a low solids-containing product containing coal extract and solvent. The second part is a high solids-containing slurry product containing coal extract, solvent and the major portion of the undissolved ash-containing hydrocarbonaceous solids. The separation may be accomplished by settling, hydroclones, centrifugation, filtration or by a combination of two or more of these unit operations.

Cooling of the extraction slurry before separation may result in selective precipitation of some of the higher molecular weight portions of the extract. At times, such cooling may be done deliberately to facilitate separation of the solids from the extract and to improve the quality of the extract. Selective precipitation of this type may be further intensified, if desired, by addition of a precipitating solvent, for example a paraffinic or naphthenic hydrocarbon. The manner in which a precipitating solvent may be advantageously used is now well known. An example of its use is fully described in U.S. Pat. No. 3,791,956.

Treatment of Low-Solids Product from Separation Zone

The low-solids liquid product issuing from the separation zone 16 is conducted without intentional cooling by a line 17 to a distillation zone 18. The primary purpose of the distillation zone is to recover the major portion of the solvent along with that part of the extract which boils below or in the boiling range of the solvent. Some distillate may be left in the extract in order to lower the naturally high viscosity of the extract. The temperature of the molten extract (which, in a solvent-free state, is a solid at temperatures below 100° C.) should be kept below that at which any coking of the extract might occur.

The distillation zone may be any suitable distillation equipment for flashing off most of the distillables, leaving a bottoms product consisting essentially of non-distillable extract, some solvent and whatever solids are in the feed to the distillation zone. The vaporous products are conducted through a conduit 19 to a fractional distillation zone 20 where they are fractionally distilled to yield a distillate fraction suitable for use as a distillate fuel and a higher boiling distillate fraction which is solvent. The distillate fuel fraction is withdrawn through conduit 21 and the solvent is recycled through conduit 12 to the liquefaction zone 10.

The coal extract is then conducted through a conduit 22 to a suitable mixing zone 23 wherein low-ash and low-sulfur carbonaceous solids are added in sufficient quantity to form a high solids-containing product which is pelletizable when hot, in forming zone 25. The amount of carbonaceous solids required for this purpose is a function of the binding properties of the extract and of the solvent, as well as the relative proportions of the extract and retained solvent. Furthermore, binder may be added extraneously to supplement the extract and solvent. If the conditions maintained in the subsequent forming zone 25 are such as to cause volatilization of the solvent, then the pelletizable mixture may, of course, be richer in solvent. But if the conditions in the forming zone do not cause volatilization of solvent, then the pelletizable mixture must be of the necessary composition for pelletization. In general, the pelletizable composition, excluding any solvent that may be vaporized in the forming zone, is typically as follows:

| | |
|---|---|
| Carbonaceous solids | 35–75 weight percent |
| Extract and solvent | 25–65 weight percent |

where the extract is generally at least 75 weight percent of the extract-solvent mix, and is preferably greater than 90 weight percent. The pellets will have substantially the same composition unless the pelletization is conducted under carbonizing conditions which result in production of some gas and tar.

The carbonaceous solids admixed with the extract in the mixing zone 23 are supplied through a conduit 24. They are preferably derived from the process itself. However, in its broadest aspects, the process of the present invention may resort to extraneous sources of carbonaceous solids, however derived.

The pelletizable composition, suitably admixed in the mixing zone, is transferred to the forming zone 25. The primary objective of the forming zone is to form pellets out of the pelletizable mass received from the mixing zone. The pellets may be made by any one of the many known pelletizing processes, for example, briquetting, extrusion or agglomeration, under carbonizing or non-carbonizing conditions at a temperature above the softening point of the binder. The process selected should be one which is adapted to be used at an elevated temperature at which the extract is fluid.

If the pellets are formed in the forming zone 25 under carbonizing conditions, that is at a temperature above 400 ° C., the resulting pellets will be sufficiently hard to permit handling. However, if no carbonization occurs in the forming zone, induration of the pellets subsequent to the forming step is required. In such event, the pellets formed in the forming zone 25 are advanced to an induration zone 26. Hardening of the pellets in the induration zone 26 may be effected by heating the pellets under carbonizing conditions, that is at a temperature above 400° C., or by simply cooling them below the softening point of the solution of extract and solvent which is generally above 150° C. Carbonization of the pellets, whether effected in the course of pellet formation in the forming zone or subsequently in a separate zone, yields a vaporous product which contains a fraction corresponding to the solvent used for the coal extraction which may be recovered for use in the liquefaction zone 10. As will be seen later in the description of the preferred embodiment, mixing, forming and induration need not be performed separately, but in any suitable or appropriate combination of steps.

Hardened pellets are withdrawn from the induration zone 26 through a conduit 27. Depending upon the forming process selected, the pellets may contain off-size pellets, that is pellets which are not suitable for the intended use, either because they are too small or too large. In such event, the off-size pellets, after suitable size adjustment, may be recycled for use as part or all of the carbonaceous solids admixed with extract in the mixing zone 23. Such recycle is shown by the lines 24 and 28. Those pellets which are within the desired range may be used as is in certain operations. For example, they may serve as part of a coke oven feed, or as solid reductant in certain ore reduction furnaces. Or they may be subjected to a temperature between 800° and 950° C. to yield blast furnace coke.

Treatment of High Solids Product from Separation Zone

At least a portion of the high solids product issuing from the separation zone 16 is transferred through a conduit 29 to a distillation zone 30 which is maintained at a temperature sufficiently high to distill off solvent, leaving a hydrocarbonaceous ash-containing solid. If extract is present, as may well be the case unless exhaustive solvent washing has been resorted to, the temperature maintained in the distillation zone 30 should be sufficiently high to carbonize the extract to coke or char and vaporous products. A suitable temperature is in the range of 425° to 760° C. The ash-containing solids are withdrawn from the zone 30 and conducted by a conduit 31 to any conventional type steam-carbon gasification zone 32 operated under conditions to yield $CH_4$, CO and $H_2$. The solid gasification residue rich in inorganic sulfur compounds is discharged from the system through a conduit 33. The gaseous product is conducted by a conduit 34 to a conventional-type gas treatment zone 35 for the recovery of hydrogen. The other principal product $CH_4$ is recovered through a conduit 36 as high Btu gas. The hydrogen is conducted by a conduit 37 to the liquefaction zone 10. As pointed out earlier, a portion of the required coal liquefaction solvent is introduced into the liquefaction zone by a conduit 13. The solvent is derived from the distillation zone 30. The vapors issuing from the latter zone are conducted by a conduit 38 to a fractional distillation zone 39 which is a conventional type. The fraction having the desired boiling range for the solvent is recovered for that purpose, while the balance may be withdrawn through conduit 40 to serve as distillate fuel. Instead of returning solvent directly to the liquefaction zone, the solvent may first be hydrogenated by the hydrogen from conduit 37 to thereby yield a hydrogen-donor solvent which may then be used as the source of hydrogen in the liquefaction zone, as is more fully shown in the preferred embodiment of FIG. 2.

PREFERRED EMBODIMENT

Figure 2:
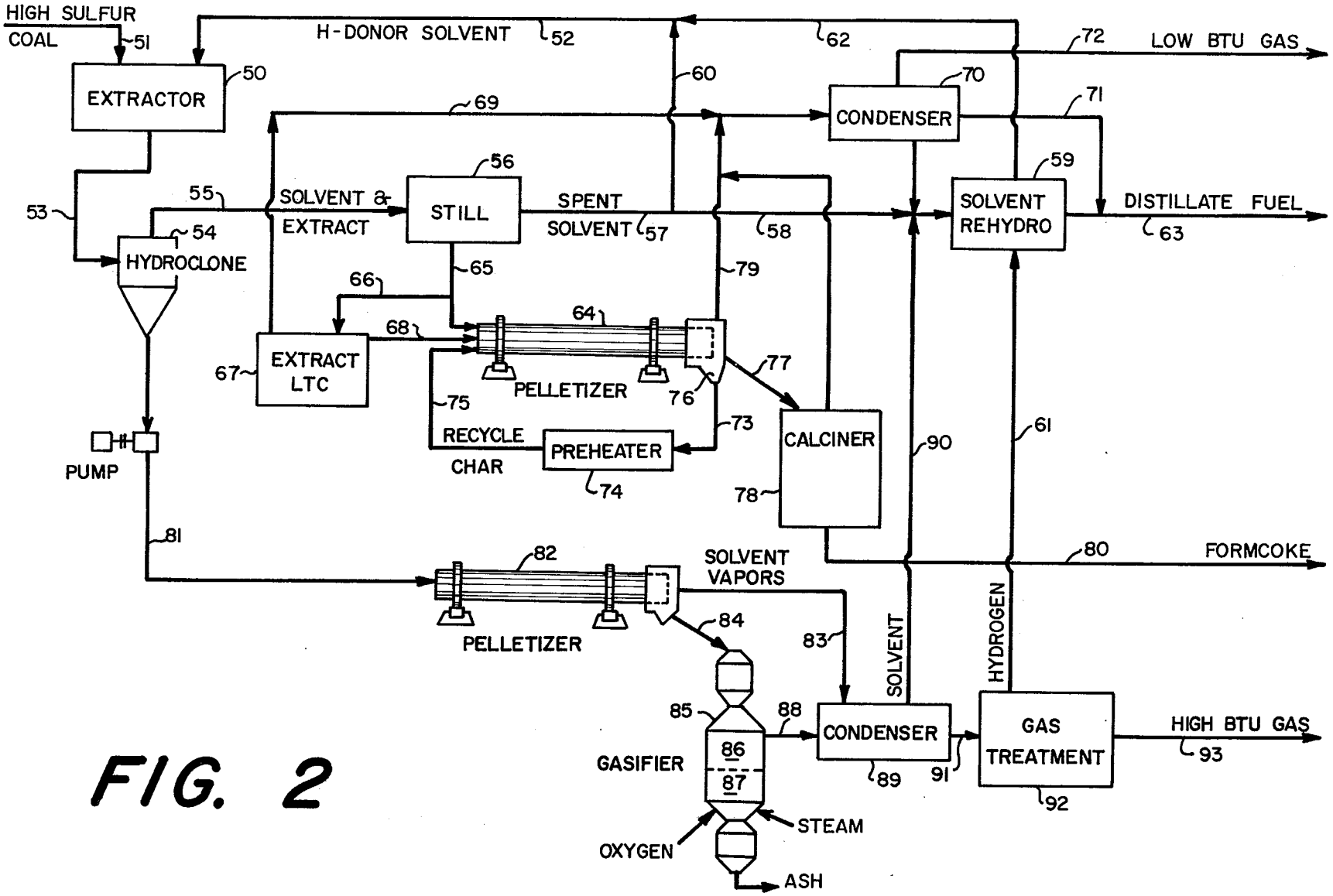
FIG. 2 is a schematic flowsheet of the preferred embodiment of the present invention.

FIG. 2 shows schematically a coal conversion plant utilizing the preferred embodiment of the present invention. It is directed specifically to the conversion of a high-sulfur coal to the low-ash and low-sulfur fuels required in a steel plant, including formcoke suitable for use in a blast furnace.

Feed Coal

A high-sulfur coal is used which has a volatile matter content of at least 20 weight percent. A typical coal suitable for use in this preferred embodiment has the composition shown in Table I below:

TABLE I

| Proximate analysis: | Wt. Percent MF* Coal |
|---|---|
| Volatile matter | 41.7 |
| Fixed carbon | 45.9 |
| Ash | 11.6 |
| Ultimate analysis: | Wt. Percent MAF** Coal |
| Hydrogen | 5.34 |
| Carbon | 78.97 |
| Nitrogen | 1.60 |
| Oxygen | 10.47 |
| Sulfur | 3.62 |

*MF means moisture-free.
**MAF means moisture-and-ash-free.

The feed coal is preferably ground to a finely divided state, for example, minus 14 mesh Tyler Standard screen, and is freed of substantially all extraneous water.

1. Coal Liquefaction Zone

The feed coal is introduced into an Extractor 50 via a conduit 51. Hydrogen donor (H-donor) solvent is introduced into the Extractor via a conduit 52. The coal and the solvent react therein to yield the desired coal extract in admixture with undissolved solids.

The solvent extraction process is a non-catalytic, continuous, countercurrent process conducted in a vertical cylindrical vessel, at a temperature in the range of 350° to 475° C., a pressure in the range of 4 to 50 kg/cm$^2$, and a solvent-to-coal ratio of 1.5 to 3.0. Under such conditions, the amount of hydrogen transferred is between 0.7 and 2.5 (weight percent MAF coal).

The solvent is a polycyclic, aromatic hydrocarbon which is liquid at the temperature and pressure of extraction, and contains partially hydrogenated aromatics. It is naturally derived from the hydrogenation of extract or fractions thereof. It usually has a relatively wide distillation range with an initial atmospheric boiling point of about 200° C. and a final boiling point of 500° C. or even higher.

2. Separation Zone

Following extraction, the effluent mixture of solvent, extract and residue is conducted rapidly from the Extractor 50 so as to avoid excessive cooling of the mixture, through a conduit 53 to a Hydroclone system 54 consisting of one or more hydroclones adapted to concentrate the solids preferentially in the underflow. While the greater part of the residue is in the product underflow from the Hydroclone system, the exact amount is controlled, firstly to assure that both overflow and underflow products are pumpable, and secondly to maintain the required distribution of low-sulfur fuels for the steel plant. While the organic sulfur has been reduced in the Extractor, the inorganic sulfur is still left in the solid residue. In this preferred embodiment of the invention, the solids content of the extract (excluding solvent) recovered from the Hydroclone system overflow may be in the range of 0.05 to 15 weight percent, while the solids content of the total underflow from the Hydroclone system may be in the range of 30 to 55 weight percent, but is generally between 40 and 55 weight percent.

3. Treatment of the Overflow from the Hydroclone System

The overflow from the Hydroclone system is pumped by a pump (not shown) through a conduit 55 to a Still 56 where at least some solvent and any light oil are fractionally distilled. The light oil is suitably recovered (not shown) for use as distillate fuel, while the spent solvent is withdrawn through a conduit 57. A portion of the spent solvent is sent through a conduit 58 to a Solvent Rehydro unit 59 while the remainder is recycled to the Extractor 50 through a conduit 60 which connects with conduit 52. The portion of the spent solvent which is sent to the Solvent Rehydro unit is subjected to the usual conditions for rehydrogenation of hydrogen-donor solvents by means of hydrogen gas introduced by conduit 61. Typical hydrogenation conditions are as follows:

| | |
|---|---|
| Temperature, ° C. | 340 |
| Pressure | 70 Kg/cm$^2$ |

-continued

| | |
|---|---|
| $H_2$ Rate | 0.9 m$^3$/Kg |
| Catalyst | 5/16 cm. pellets of NiS-$MoS_2$ on $Al_2O_3$ |
| LHSV | 2 |

The hydrogenation product is fractionated to recover the rehydrogenated solvent which is returned to the Extractor through a conduit 62 and conduit 52. The remainder is withdrawn through a conduit 63 for use as distillate fuel.

The extract-containing portion recovered in the Still 56 is conducted to a Pelletizer 64 through a conduit 65. The Pelletizer consists essentially of a rotary cylindrical kiln, usually slightly inclined from the horizontal. It serves to mix, form and harden pellets all in the same vessel. The extract-containing portion contains not only extract, but also some solvent, and in the case of this preferred embodiment, less than about 5 percent by weight of solids. In order to establish a pelletizable mass in the Pelletizer 64, the feed to the Pelletizer, when admixed in the Pelletizer, should have about the following composition, excluding any solvent that may be vaporized in the Pelletizer:

| | Weight Percent |
|---|---|
| Solids | 60–75 |
| Extract and Solvent | 25–40 |

The composition of the pelletizable mass is, to some extent, dependent upon the density of the solids, the higher the density the less binder is required. The reason for this is presumably absorption of binder in the pores of the less dense solids.

As previously stated, there is generally less than 5 percent solids in the extract-containing stream to the Pelletizer. Accordingly, it is necessary to provide a substantial amount of solids to raise the weight percent to the required range of 60–75. This may be done in one or both of two ways. Firstly, a portion of the extract feedstream is diverted through a conduit 66 to an Extract LTC unit 67 adapted to subject the extract to low temperature carbonization, that is to heat at 425° to 500° C. whereby a char product is obtained which is conducted to the Pelletizer through a conduit 68. A vaporous product is also obtained, which is conducted by a conduit 69 to a condenser 70 where the liquefiable portion is condensed and withdrawn through a conduit 71 for use as distillate fuel. The non-liquefiable portion is withdrawn through a conduit 72 for use as low Btu gas.

The other way to raise the solids content of the pelletizable mass to within the desired range is to recycle off-size pellets from the Pelletizer through a conduit 73, a preheater 74, and a conduit 75. If the solids content of the extract feedstream is sufficiently greater than 5 percent, as might be the case in certain non-preferred embodiments, then the recycle pellets will provide all the additional solids needed so that carbonization of extract becomes unnecessary.

The pelletizable mass of the desired composition is subjected to pelletization under adiabatic low temperature carbonization conditions at a temperature above 400° C. as is now well known. For example, the operation of the Pelletizer 64 is set forth in U.S. Pat. No.

3,401,089, granted Sept. 10, 1968 to R. J. Friedrich et al. The pellets of the desired size consist are withdrawn from a separator 76 located at the end of the rotary kiln and conducted by a conduit 77 to a Calciner 78. The off-size pellets, as previously stated, are recycled with appropriate crushing as may be required to yield the desired size consist for use in the pelletizable mass. The vaporous product from the kiln is withdrawn through a conduit 79 to join conduit 69 leading to the condenser 70.

The Calciner 78 is adapted to heat the pellets of desired size, generally 60 mm × 20 mm, to a temperature between 800° and 950° C. at a pressure between 0 (1 atmospheric absolute) and 15 kg/cm². The calcined pellets are withdrawn through a conduit 80 for use as formcoke in a blast furnace.

4. Treatment of the Underflow from the Hydroclone System

The solids-rich underflow from the Hydroclone 54 is pumped through a conduit 81 to a Pelletizer 82 after appropriate adjustment of the composition of the underflow to yield a pelletizable mass in the Pelletizer. The desired composition is generally the same as that set forth for the composition maintained in Pelletizer 64 and is generally established by appropriate removal of solvent in the proper amount. However, the function and operation of Pelletizer 82 are not the same as that of Pelletizer 64. In this instance, the Pelletizer 82 serves to mix and to form pellets in much the same manner as does Pelletizer 64 but under non-carbonizing conditions, i.e. at temperatures between 300° and 370° C., high enough to vaporize the solvent during the formation of the pellets. The vaporous solvent may be removed through a conduit 83 for condensation and reuse. The formed pellets may need to be water-quenched (not shown) to harden them for subsequent handling. They are withdrawn from the Pelletizer 82 through a conduit 84 to a Gasifier 85.

The preferred size of pellets for use in the Gasifier 85 is greater than 14 mesh Tyler Standard screen. If there are any pellets above about 5 cm, then it is desirable to crush them to less than 5 cm. The portion of the pellets (including the crushed oversize pellets) which is less than 14 mesh in size is separated and may be recycled to the inlet of the Pelletizer 82. In such case, due recognition of this recycle stream of solids must be given in the maintenance of the desired composition. The pellets of desired size are then conveyed through the conduit 84 to the Gasifier 85.

The Gasifier 85 is preferably of the fixed bed type, requiring a non-caking or weakly caking carbonaceous feed for satisfactory commercial operation. In such a gasifier, a bed of pellets which are relatively stationary with respect to each other moves progressively downwardly first through a carbonization zone 86 and then through a gasification zone 87. Steam and oxygen are introduced into the gasification zone and are circulated upwardly through the downwardly moving bed while ash is suitably rejected from the bottom of the gasifier. The temperatures in the carbonization zone are maintained within the range 500° to 775° C. by the hot gases issuing from the gasification zone. The gasification zone is maintained at a temperature in the range of 775° to 1050° C. The pressure is 20 to 40 kg/cm². The incoming pellets are carbonized in the carbonization zone, yielding tar vapors which are withdrawn with the effluent gases via a conduit 88. The carbonized pellets move downwardly in reactive contact with the upflowing steam and oxygen to form $CO_2$, $CH_4$, $H_2$, and CO. These pass through the carbonization zone and into conduit 88. The effluent gas, including tar and solvent vapors is passed into a condenser 89 for separate recovery of gas, solvent and tar. Solvent is recovered from the condenser and conducted via a conduit 90 to connect with conduit 58 which leads to the Solvent Rehydro unit 59. The tar-free gas is conducted by a conduit 91 to a suitable hydrogen recovery system 92 of conventional type from which a hydrogen-enriched gas is recovered. This gas is withdrawn through conduit 61 to serve in the rehydrogenation of the solvent. The remaining gas is withdrawn through a conduit 93 to serve as a high Btu gas.

The ash and sulfur contents of the spectrum of products shown in FIG. 2 will naturally depend upon the specific conditions selected for each of the described essential operations. The more severe the conditions of hydrogenation maintained in the Extractor 50, the larger is the amount of organic sulfur that is removed. The more effective the separation of solids, i.e. ash, from the extract in the Hydroclone system 54, the lower will be the ash and hence sulfur content of the solid, liquid and gaseous products since the major part of the inorganic sulfur will be rejected as ash from the Gasifier 85. However, it may be desirable from an economic point of view to accept to tolerate some ash and sulfur, without impairing the usefulness of the product or doing harm to the environment. The process of the present invention permits both flexibility and selectivity in modifying not only the distribution of products, but also their respective compositions.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

We claim:

1. In a coal conversion process which includes extraction of coal by a solvent to yield a mixture of coal extract, solvent and undissolved ash- and sulfur-containing hydrocarbonaceous residue, the IMPROVEMENT which comprises:

a. subjecting said coal to solvent extraction and hydrotreatment in a coal liquefaction zone under hydrodesulfurizing conditions wherebv said coal extract has a lower organic sulfur content than said coal;

b. separating the effluent mixture from said coal liquefaction zone into at least two parts, the first part being a low solids-containing product containing coal extract and the second part being a high solids-containing product containing undissolved ash- and sulfur-containing hydrocarbonaceous residue;

c. forming low-ash and low-sulfur pellets from a mixture consisting essentially of coal extract contained in said first part and carbonaceous solids;

d. subjecting said second part to distillation to yield a hydrocarbonaceous ash-containing solid and a hydrocarbonaceous distillate including solvent;

e. reacting said hydrocarbonaceous ash-containing solid with steam in a gasification zone to yield a gaseous product and ash; and f. treating said gaseous product from said gasification zone to yield a methane-rich gas and hydrogen for use in said liquefaction zone.

2. A process for converting coal to a low-ash, low-sulfur formcoke which comprises:

a. subjecting said coal to extraction in a liquefaction zone by a hydrogen-donor solvent under desulfurizing conditions to yield an effluent mixture of coal extract of reduced organic sulfur content, solvent and undissolved carbonaceous residue;

b. effecting separation of said effluent mixture into at least two parts, the first part being a low solids-containing product containing coal extract and solvent and the second part being a high solids-containing product containing coal extract, solvent and undissolved carbonaceous residue;

c. removing solvent from said first part and subjecting at least a portion thereof to hydrogenation to replenish the hydrogen-donor solvent used in step (a);

d. forming pellets in a first pelletizing zone under low temperature carbonization conditions from a mixture consisting essentially of coal extract contained in said first part and carbonaceous solids derived from coal extract produced in step (a);

e. recycling a portion of the pellets formed in step (d) to said first pelletizing zone to serve as the required carbonaceous solids;

f. subjecting at least a portion of the pellets from step (d) to calcination to produce a low-ash and low-sulfur formcoke;

g. adjusting the relative proportions of coal extract, solvent and undissolved carbonaceous residue in said second part to yield a flowable mass which is pelletizable;

h. forming pellets from said pelletizable mass in a second pelletizing zone;

i. subjecting at least a portion of said pellets from said second pelletizing zone to carbonization; and j. subjecting said carbonized pellets to gasification in a gasification zone to yield a gas from which hydrogen is recovered to hydrogenate said solvent in step (c).

3. The process according to claim 2 in which the separation of step (b) is effected by a hydroclone system whereby the first and second parts are pumpable overflow and underflow products, respectively.

4. The process according to claim 3 wherein the composition of the mixture in said first pelletizing zone is adjusted to have the following composition, excluding any solvent that may be vaporized in said first pelletizing zone,

| | Weight Percent |
|---|---|
| Solids | 60–75 |
| Extract and Solvent | 25–40 |

5. The process according to claim 4 wherein the forming of the pellets in step (d) is effected in a rotary kiln under adiabatic conditions at a temperature above 400° C.

6. The process according to claim 5 wherein the calcination of step (f) is conducted at a temperature between 800° and 950° C. and at a pressure between 0 and 15 kg/cm$^2$.

7. A plant for the conversion of high-sulfur coal to low-sulfur solid, liquid and gaseous fuels for use in a steel plant comprising:

a. a coal solvent extraction and hydrotreatment complex in which an effluent mixture of solvent, extract and undissolved residue is produced;

b. a hydroclone system consisting of at least one hydroclone adapted to separate into a pumpable overflow stream and a pumpable underflow stream while at the same time concentrating the solids preferentially in the underflow;

c. separate means for adjusting the compositions of the overflow and the underflow, respectively, from the hydroclone system to form pelletizable masses;

d. separate pelletizers for forming pellets from the pelletizable masses, respectively;

e. a calciner adapted to heat the pellets formed from the pelletizable mass derived from the overflow to produce a low-sulfur formcoke suitable for use in a blast furnace;

f. a gasification complex for the production of a hydrogen-rich gas and a low-sulfur high-Btu gas; and g. means for conducting said hydrogen-rich gas to said coal solvent extraction and hydrotreatment complex to serve for hydrotreatment of said coal during the solvent extraction.

* * * * *